US006216646B1

(12) United States Patent
Smith et al.

(10) Patent No.: US 6,216,646 B1
(45) Date of Patent: Apr. 17, 2001

(54) DEAERATION BOTTLE FOR LIQUID COOLING SYSTEMS FOR AUTOMOTIVE VEHICLE ENGINES

(75) Inventors: Gary M. Smith, Waterford; Ronald A. Reese, II, Goodrich; Ladd S. Lubaczewski, Jr., Washington Township; Peter A. Varma, Royal Oak, all of MI (US); Gavin J. DeNyse, Cambridge, MA (US); Christopher J. Hauer, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/471,900

(22) Filed: Dec. 23, 1999

(51) Int. Cl.[7] ..... F01P 3/22
(52) U.S. Cl. ..... 123/41.54; 165/104.32
(58) Field of Search ..... 123/41.54; 165/104.32

(56) References Cited

U.S. PATENT DOCUMENTS 4,723,596 2/1988 Spindelboeck et al. .
5,139,082 * 8/1992 McEachern, Jr. ..... 165/104.32
5,329,889 7/1994 Caldwell .
5,456,218 * 10/1995 Theorell ..... 123/41.54
5,680,833 10/1997 Smith .
5,829,268 * 11/1998 Mertens ..... 62/503
5,992,481 * 11/1999 Smith ..... 141/326

* cited by examiner

*Primary Examiner*—Willis R. Wolfe
*Assistant Examiner*—Hai Huynh
(74) *Attorney, Agent, or Firm*—Kenneth H. Maclean

(57) ABSTRACT

An engine cooling system for an automotive vehicle including a liquid coolant deaeration and overflow bottle having plural cells constituting a degassing chamber assembly with the first cell having only an upper fluid inlet for initially receiving liquid coolant from the engine cooling system and a lower flow-through window which leads into an adjacent cell for receiving coolant from the first cell. The other cells are likewise connected together in series and the final cell has an outlet connected back into the engine cooling system. Coolant in the cells of the degassing chamber assembly creates a liquid trap arrangement to prevent any substantial back flow of accumulated air from the deaeration chamber assembly back into the engine's cooling system when engine operation is terminated. Most importantly, this prevents any formation of air bubbles in the heater core circuit which may restrict coolant flow and seriously degrade heater effectiveness, particularly at idle and low engine speed operation.

4 Claims, 3 Drawing Sheets

DEAERATION BOTTLE FOR LIQUID COOLING SYSTEMS FOR AUTOMOTIVE VEHICLE ENGINES

BACKGROUND OF THE INVENTION

Current active deaeration and degassing systems for automotive cooling systems utilize a coolant bottle having a degassing chamber through which a part of the engine cooling fluid is passed continuously for the purpose of accumulating and separating gas, i.e. air from the coolant. Such deaeration systems work best when there is a designated air space in the coolant bottle for collection of any air removed from the coolant. Such systems work with high efficiency when the coolant bottle is elevated significantly above the level of coolant in the rest of the cooling system particularly the coolant level in the engine so that any air collected is maintained in the coolant bottle. However, due to lower hood lines in modern automobiles, positioning a coolant deaeration bottle above the level of coolant in the rest of the cooling system circuit is usually impossible. When the coolant bottle is not located well above the rest of the circuit, air collected in the coolant bottle can back flow into the engine's coolant circuit after operation of the engine is terminated. Often when collected air is moved out of the coolant bottle it migrates as air bubbles to the vehicle's heater used to warm the vehicle's passenger compartment. These air bubbles may prevent desirable quantities of coolant flow through the heater core, particularly during engine idling. Decreased coolant flow through the heater core prevents the heater system from initially and rapidly warming the cabin of the vehicle. Accordingly, migration of air bubbles from the heater back to the coolant bottle requires an extended operating time of the engine including relatively great engine speeds and corresponding water pump speeds. This procedure repeats itself over and over with each engine start-up/termination cycle and has the effect of diminishing effective warming of the vehicle's interior.

1. Field of the Invention

The present invention relates to an improved liquid cooling system for an automotive internal combustion engines and heater system for a vehicle's cabin which features a multi-celled deaeration bottle with a separate cell in which the location of the inlet and exit creates a liquid level defined air trap which prevents any significant flow of air collected in the bottle back into the engine or the beater.

2. Prior Art

Prior to the present invention, various vehicle engine cooling systems have employed a wide range of components for improving vehicle engine cooling. Pressurized deaeration or degassing bottles in liquid cooling systems have been used to remove suspended air from liquid coolant to improve heat transfer efficiency. Examples of such prior system are disclosed in: U.S. Pat. No. 5,329,889 issued to D. Caldwell for "Degas Tank for Engine Cooling System"; U.S. Pat. No. 4,723,596 issued to D. Splindleboech et al for "Expansion, Deaeration and Reservoir Tank For the Liquid Cooling System of Internal Combustion Engines"; and U.S. Pat. No. 5,680,833 to G. Smith for "Combination Coolant Deaeration and Overflow Bottle".

SUMMARY OF THE INVENTION

While prior deaeration bottles and systems are effective to degas engine coolants, they do not prevent any collected air removed from the liquid coolant from returning to the engine cooling system. Typically, such back flow of air occurs particularly after an engine is shut down, subsequently restarted, and then idled or otherwise run at a relatively low speed. The present invention concerns a new and improved deaeration assembly including a degas bottle operatively connected to the engine's cooling system which also includes a connected heater for the passenger compartment. The degas bottle can be effectively located at any position relative to the coolant level of the other cooling system components and still is effective in maintaining separation of air from liquid coolant. This prevents migration of air bubbles to the passenger compartment heater core by back flow from the bottle into the active portion of the cooling system, particularly during engine cool-down after termination of engine operation. The heater core can accordingly operate with optimized efficiency even at engine idle and low speed operation.

DETAILED DESCRIPTION OF THE PREFERRED EMBODIMENT

Figure 1:
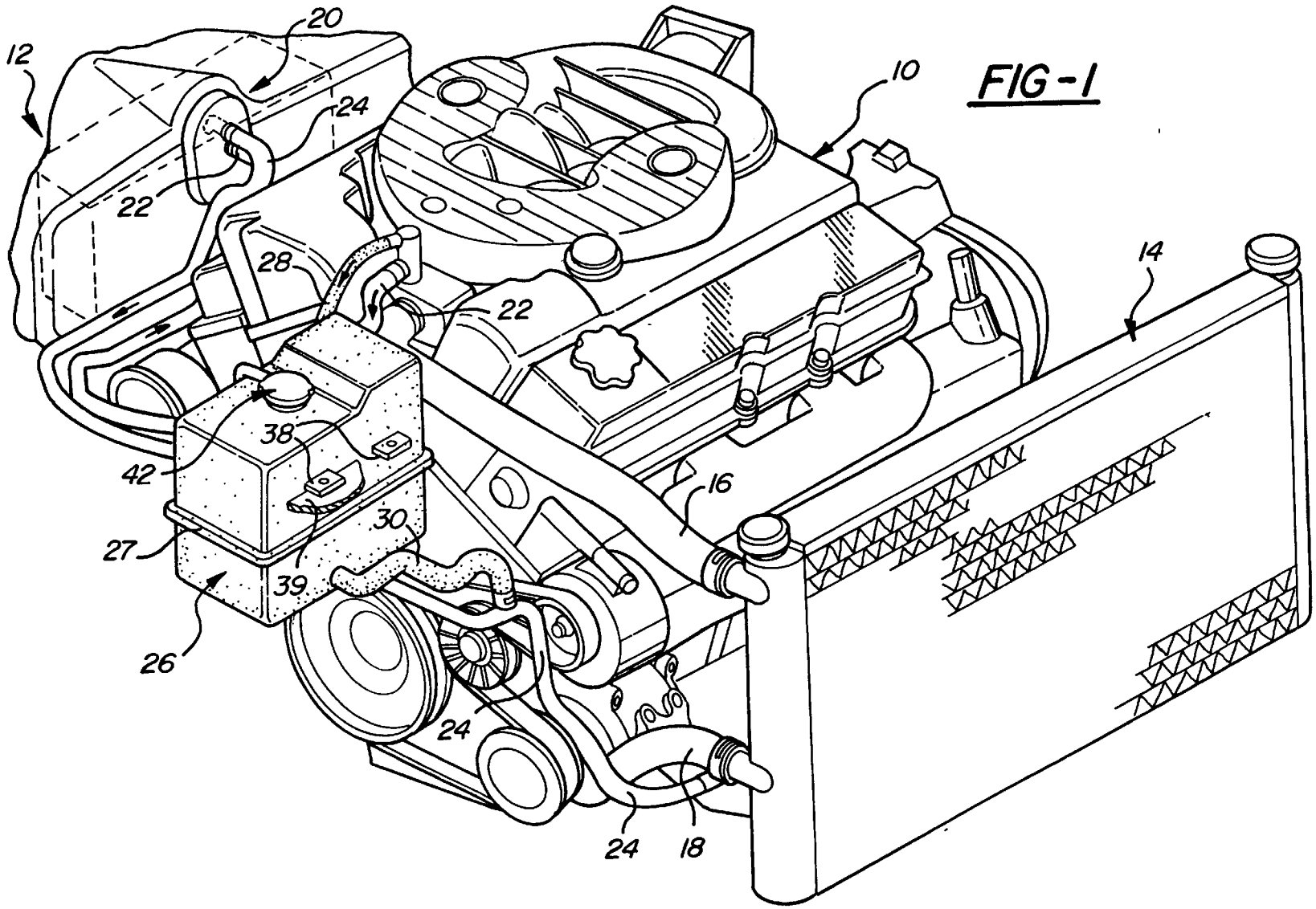
FIG. 1 is a pictorial view of an internal combustion engine with cooling components including an associated radiator, a passenger compartment heater assembly, and a coolant deaeration and overflow assembly operatively interconnected together in a liquid coolant system.

Turning now in greater detail to the drawings, illustrated in FIG. 1 is a liquid cooling system for an internal combustion engine 10 of an automotive vehicle 12. The engine 10 is a conventional liquid cooled engine including water jackets or compartments through which liquid coolant is pumped. These compartments are connected to a heat-dissipating radiator 14 by inlet and return hoses 16 and 18. The engine water jacket and other components are also hydraulically connected to an occupant compartment heater assembly 20 by inlet and return hoses 22, 24 respectively and further to a liquid coolant deaeration (degassifier) and overflow assembly (bottle) 26 by supply and outlet hoses 28 and 30. Liquid coolant in the cooling system is pumped by a conventional engine driven pump (internal to engine 10) to cause the liquid coolant to flow through the cooling system.

Figure 2:
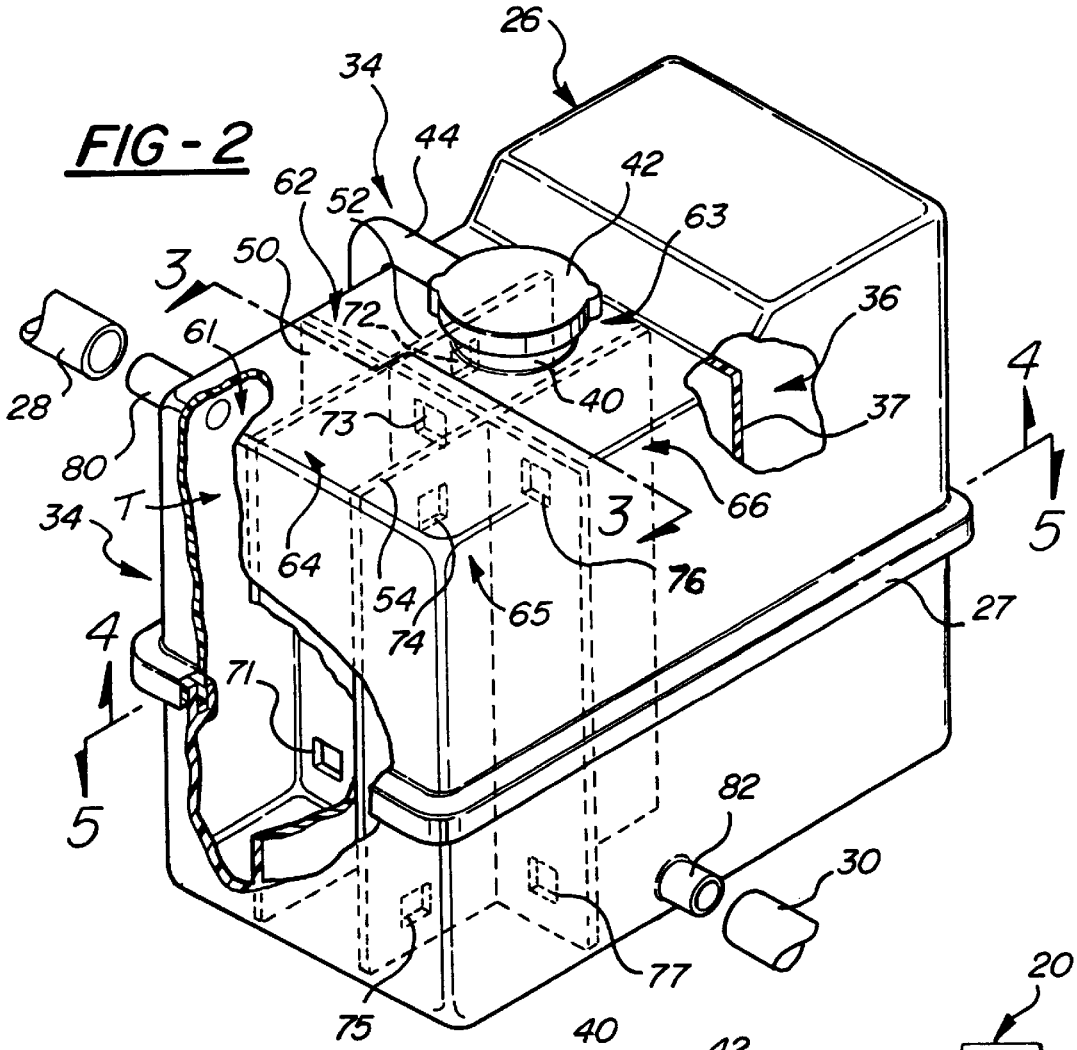
FIG. 2 is an enlarged pictorial view of the coolant deaeration and overflow bottle shown in FIG. 1 with parts broken away to show internal cellular structure thereof.

Referring now to FIG. 2, the deaeration and overflow assembly or bottle 26 is a closed, multi-part container formed from upper and lower halves preferably made of plastic material which halves are fused together at mid-section horizontal flanges 27. The bottle 26 has a first operating section providing a degassing chamber portion 34 for the purpose of extracting gas, primarily air, from the liquid coolant which is circulated through the system. Bottle 26 also has a second operating section which acts as a liquid coolant overflow chamber portion 36 for the purpose of collecting any liquid coolant which overflows from the degassifier chamber, particularly as the liquid expands during engine warm-up. The two portions 34, 36 are advantageously arranged in a side by side lateral relationship and separated by a common divider wall 37. Integral brackets 38, best seen in FIG. 1, are provided to attach the bottle assembly 26 to vehicle support structure 39 in the engine compartment. A desirable attachment for the bottle is disclosed in the above referenced U.S. Pat. No. 5,680,833 assigned to the assignee of this invention and hereby incorporated by reference.

Figure 3:
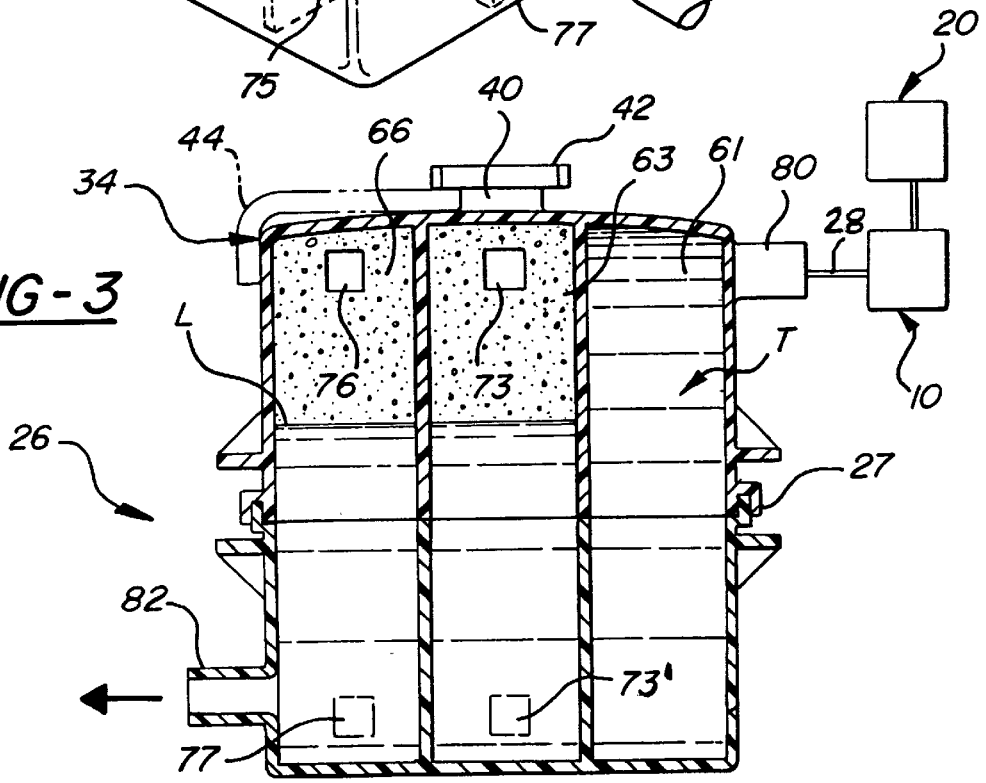
FIG. 3 is a sectioned end view of the deaeration and overflow bottle of FIG. 2 taken generally along sight lines 3—3 of FIG. 2 and with a diagram added thereto.

Because of vehicle design constraints, such as desirable low hood lines, the deaeration and overflow bottle assembly 26 must often be positioned at an elevation lower than the heater assembly 20 as shown schematically in FIG. 3. The degas portion or section 34 of the bottle assembly 26 is hydraulically or fluidly connected to the overflow portion or section 36 by a connection passage provided by coolant fill neck 40. A hose 44 runs from the filler neck 40 to an inlet fitting (not shown) into the overflow chamber 36 as more particularly disclosed by the above referenced U.S. Pat. No. 5,680,833. The coolant fill neck 40 is normally covered by a pressure cap 42 which allows flow therethrough from the interior of degas chamber 34 through hose 44 and into the overflow chamber 36 as coolant expands. Conversely, the pressure cap permits coolant flow from the overflow chamber 36, through hose 44 and into the degas chamber 34 as coolant in the engine contracts.

When the engine is running, the coolant pump passes liquid coolant and any air in the engine through inlet hose 28 into the degas chamber 34. Conversely, when the engine cools after a shut-down, liquid coolant in the engine contracts and a partial vacuum condition may be created which induces coolant flow from the degas chamber 34, through hoses 30 and 28 and back into the engine's water jackets.

The degassing portion or chamber 34 is best shown in FIGS. 2–3 and is a multi-cell structure created by being divided in grid-like fashion by internal walls or partitions 50, 52 and 54. Walls 50, 52, and 54 intersect one another substantially at right angles to define a plurality of vertically extending hollow cells 61, 62, 63, 64, 65, and 66. These cells are enclosed by the outer wall of the degassing chamber portion 34 and by the internal divider wall 37. These cells are hydraulically interconnected to one another by strategically located flow-through ports or windows 71, 72, 73, 74, 75, 76, and 77 formed through the walls 50, 52 and 54. Moreover, these windows are arranged to hydraulically connect the cells in series flow relationship to one another so that the flow path through the degassing chamber portion 34 creates a series of degassing steps to maximize the degassing or deaeration function of the assembly 26. Specifically, coolant flows through the cells 61, 62, 63, 64, 65, and 66 sequentially starting from the inlet 80 fitting connecting inlet hose 28 to the first cell 61 and ending at the outlet fitting 82 connecting the final cell 66 to the outlet hose 30.

More particularly, the first cell 61 of the degassing section has inlet fitting 80 located adjacent to the top of the container's side wall where coolant enters first cell 61 from hose 28 as best shown in FIGS. 2 and 3. A strategically located lower flow-through window 71 in interior wall 50 communicates the first cell 61 with adjacent second cell 62. The portion of wall 50 between adjacent cells 61, 62 has no other openings and therefore this arrangement isolates the upper portion of cell 61 and its inlet formed by fitting 80 from the other cells whenever a significant coolant volume fills first cell 61. The second cell 62 fluidly communicates with adjacent third cell 63 by a window 72 through the upper portion of the common wall portion 52 (and through a lower window 72' described in the following paragraph). The vertical elevation of window 72 is approximately at the same height as the inlet fitting 80 into cell 61. In turn, coolant in cell 63 communicates with and can flow therefrom into adjacent fourth cell 64 through an upper window 73 (and a lower window 73' described in the next paragraph). Window 73 extends through the upper portion of the common wall 50 dividing cells 63, 64. Likewise, coolant in fourth cell 64 communicates with and can flow therefrom into the adjacent fifth cell 65 through a pair of windows 74 and 75 which are formed in the common portion of the wall 54 which separates cells 64, 65. Again, coolant in cell 65 communicates with and can flow therefrom into the adjacent sixth cell 66 through upper and lower windows 76, 77 in the common portion of the wall 50 between these cells 65, 66.

Figure 4:
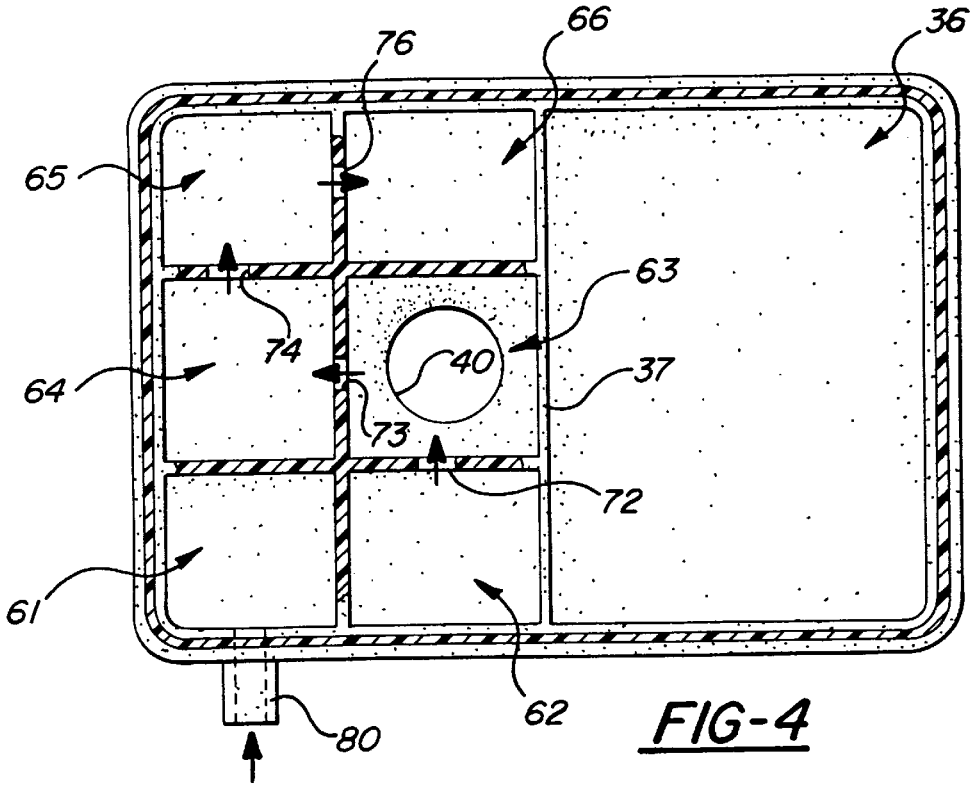
FIGS. 4 and 5 are sectioned views partially broken away taken respectively along sight lines 4—4 and 5—5 of FIG. 2.
Figure 5:
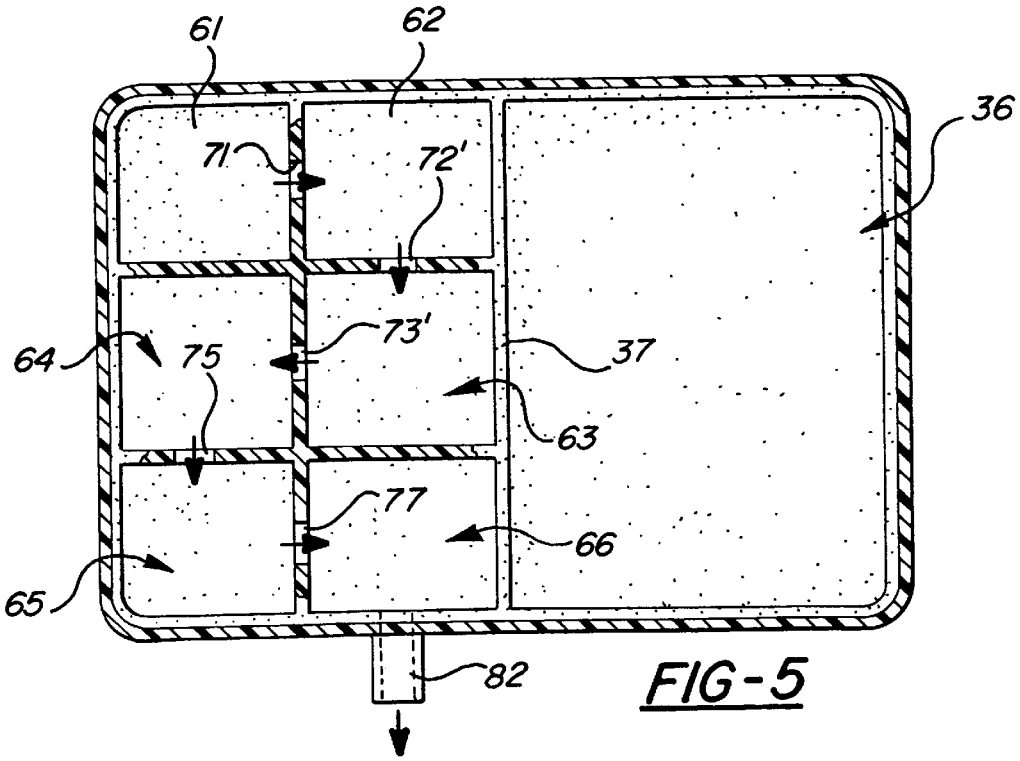

The fluid connection between first cell 61 and second cell 62 by window 71 is shown fairly clearly in FIG. 2 due to the broken out section. Likewise, the location and functionality of windows 72, 73, 74, 75, 76, and 77 between various cells 62, 63, 64, 65, and 66 is readily understood from FIGS. 2 and 3. However, additional windows in the walls 50, 52, and 54 are not visible in these views and therefore reference is made to FIGS. 4 and 5 which disclose the location of additional windows as follows: a lower window 72' (in FIG. 5) between cells 62, 63; and a lower window 73' (in FIG. 5) between cells 63, 64.

With the strategic locations of the various windows, a liquid surface formed air trap space, designated "T", is created within the degassifier section 34 defined by the surface of the liquid coolant within the first cell 61. This gas trap space T effectively prevents gas or air bubbles trapped and collected at the top of cells 62-66 which are lighter than the liquid coolant from flowing back into the engine cooling system and into the heater core through inlet fitting 80. Such flow would otherwise occur on engine shut down and contraction of the liquid coolant in the engine's water jackets which creates a partial vacuum therein. Accordingly, these air bubbles are prevented from collecting in the vehicle's heater core which is typically located at a higher elevation than the engine. Due to the prevention of the collection of air bubbles in the heater, the flow of engine coolant therethrough is enhanced especially when the engine is substantially restarted. Accordingly, without a restriction to flow by air bubbles, the heater operates with optimized efficiency at all engine speeds including idle so that the vehicle cabin can be efficiently warmed.

While a preferred embodiment of the invention has been shown and described, another cell arrangement and flow-through window pattern of other embodiments would now be apparent to those skilled in the art. Accordingly, this invention is not to be limited to that which is shown and described but by the following claims.

We claim:

1. A coolant deaeration bottle for operative connection to an engine cooling and cabin heating system of an internal combustion engine for an automotive vehicle having a degassing chamber comprising an enclosing outer wall and a plurality of partitions therein intersecting one another to at least divide said chamber into a plurality of cells defined by a vertically extending coolant inlet cell and an adjacent vertically extending coolant receiving and outlet cell, said cells having discrete upper and lower end portions, an opening in the upper end portion of said inlet cell for receiving liquid coolant from said system, said inlet cell having a second opening in the lower portion thereof for transmitting flow from said coolant inlet cell to said adjacent coolant receiving cell, said outer wall of said degassing chamber having an outlet passage therein operatively connecting said coolant receiving cell for returning coolant to said system, said cells being hydraulically interconnected by said openings so that fluid flows through said degassing chamber in a circuitous path for deaeration of said coolant when said coolant is operative to effect engine cooling operation, said coolant being confined in said inlet cell to provides a liquid trap to block the flow of air degassed from said coolant from said degassing chamber back into said engine on engine cool down so that air will not collect in the cabin heating component of said system.

2. A coolant deaeration bottle for operative connection to an engine cooling and cabin heating system of an internal combustion engine for an automotive vehicle comprising a degassing chamber having an enclosing outer wall and a plurality of partitions therein intersecting one another to at least separate said chamber into a plurality of discrete and vertically extending cells disposed adjacent to one another, said cells having discrete upper and lower portions, an opening in the upper portion of a first of said cells for receiving liquid coolant flowing from the cooling system of said engine, said first cell further having a second opening in the lower portion thereof for transmitting flow from said first cell to said adjacent and second cell, at least one other cell hydraulically connected in series to said second cell, said outer wall of said degassing chamber having an outlet passage therein operatively connecting said coolant receiving and cell for returning coolant to said cooling system for said engine, said cells being hydraulically interconnected by said openings so that fluid flows through said degassing chamber in a circuitous path for deaeration of said coolant when said coolant is operative to effect engine cooling, said coolant being confined in said first cell in a manner to provide a liquid trap to block the flow of air degassed from said coolant from said degassing chamber back into said engine on engine cool down so that air will not collect in the cabin heating portion of said system.

3. A coolant deaeration bottle for operative connection to a liquid cooling system for an internal combustion engine of an automotive vehicle, said system having a heating circuit for heating the cabin of the vehicle said heating circuit including a heater core located at a position above the position of said bottle, said bottle comprising a main coolant deaeration chamber having an enclosing outer wall, a coolant inlet cell and an adjacent coolant receiving and flow through cell operatively connected in series with one another, an opening in the upper portion of said inlet cell for receiving liquid coolant from the cooling system of said engine, said inlet cell having a second opening adjacent the lower end thereof for transmitting coolant flow from said coolant inlet cell to said adjacent coolant receiving cell, said coolant receiving cell having an outlet passage therein operatively connected to the return of said system so that fluid flows through said cells in series and in a circuitous manner for effecting the deaeration of said coolant when said coolant is operative to effect engine cooling, said inlet cell being filled with a sufficient quantity of said coolant to provide a liquid trap to block the flow of air degassed from said coolant and collected in said chamber from moving back into said engine on engine shut-down so that bubbles of air degassed from said coolant cannot collect in the heater core of said engine cooling system.

4. A coolant deaeration bottle for operative connection to a liquid cooling system for an internal combustion engine of an automotive vehicle said system having a heating circuit for the cabin of the vehicle, said bottle comprising a main coolant deaeration chamber having an enclosing outer wall, a coolant inlet cell and a plurality of adjacent coolant receiving and flow through cells operatively connected in series with one another, an opening in the upper portion of said inlet cell for receiving liquid coolant from the cooling system of said engine, said inlet cell having a second opening adjacent the lower end thereof for transmitting flow from said coolant inlet cell to said adjacent coolant receiving cell, said final coolant receiving cell in said series of cells having an outlet passage therein operatively connected to the return of said system so that fluid circuitously flows through said cells in a series path for deaeration of said coolant when said coolant is operative to effect engine cooling operation, said inlet cell being filled with a sufficient quantity of said coolant to provide a liquid trap to block the flow of air degassed from said coolant and collected in said chamber from moving back into said engine on engine shut-down so that air will not collect in the heater circuit of said engine cooling system.

* * * * *